US005668434A

United States Patent [19]

Kim et al.

[11] Patent Number: 5,668,434

[45] Date of Patent: Sep. 16, 1997

[54] DIRECTLY HEATED CATHODE FOR CATHODE RAY TUBE

[75] Inventors: Chang-seob Kim, Suwon; Seok-bong Son, Kyungki-do; Bong-uk Jeong; Sang-kyun Kim, both of Seoul; Sang-uk Shin, Suwon, all of Rep. of Korea

[73] Assignee: Samsung Display Devices Co., Ltd., Kyungki-do, Rep. of Korea

[21] Appl. No.: 568,380

[22] Filed: Dec. 6, 1995

[30] Foreign Application Priority Data

Dec. 7, 1994 [KR] Rep. of Korea ..... 94-33109
Dec. 29, 1994 [KR] Rep. of Korea ..... 94-38990

[51] Int. Cl.[6] ..... H01J 1/14; H01J 19/06; H01J 1/16; H01J 19/10

[52] U.S. Cl. ..... 313/346 R; 313/345; 313/346 DC; 313/336

[58] Field of Search ..... 313/238, 269, 313/270, 337, 345, 346 DC, 346 R, 355, 411, 451

[56] References Cited

U.S. PATENT DOCUMENTS

| | | | |
|---|---|---|---|
| 4,313,854 | 2/1982 | Sunahara et al. | 313/346 R |
| 4,349,766 | 9/1982 | Ando et al. | 313/346 R |
| 4,382,206 | 5/1983 | Kumada et al. | 313/346 R |
| 4,823,044 | 4/1989 | Falce | 313/346 |
| 4,843,277 | 6/1989 | Winkler et al. | 313/346 R |
| 5,057,736 | 10/1991 | Noda et al. | 313/346 R X |

*Primary Examiner*—Sandra L. O'Shea
*Assistant Examiner*—Mark Haynes
*Attorney, Agent, or Firm*—Leydig, Voit & Mayer, Ltd.

[57] ABSTRACT

A directly heated cathode structure includes a porous pellet impregnated with a cathode material, filaments connected to the porous pellet, a support supporting the filament, and an insulation block supporting the support, wherein the filaments are supported on the porous pellet by at least one auxiliary member. The supporting structure is very strong and the quality and productivity can be greatly improved by improvement of the filament welding process using the auxiliary members.

24 Claims, 7 Drawing Sheets

DIRECTLY HEATED CATHODE FOR CATHODE RAY TUBE

BACKGROUND OF THE INVENTION

The present invention relates to a directly heated cathode for a cathode ray tube (CRT), and more particularly, to a cathode structure of an electron gun for a cathode ray tube.

Cathodes for emitting thermions in response to heat energy can be largely divided into indirectly heated and directly heated types, according to the manner in which the emitting source material is heated, with the filament and emitting source being physically separated in indirectly heated cathodes and in contact with each other in directly heated cathodes. The former, which are typically applied to electron guns requiring a great quantity of thermions, includes a sleeve into which a filament is incorporated and a base metal or reservoir fixed to the sleeve.

In the directly heated cathode, on the other hand, the base metal or reservoir is affixed directly to the filament, for application to electron guns for smaller CRTs such as those used in the viewfinder of a video camera. Here, the base metal is coated with oxide material. The reservoir can be applied to a large-screen or industrial CRT requiring a large current, and a typical example is a porous pellet impregnated with cathode material as the thermion-emitting source.

In the conventional directly heated cathode structure, a porous pellet structure directly fixed to the filament has been proposed by the present applicant. As shown in FIG. 1, a pair of filaments 102 are directly in contact with sides of a porous pellet 101 wherein electron-radiating material is impregnated. In such a conventional directly heated cathode structure, according to the type of the filament, the filament 102*a* is directly welded to the sides of the pellet 101, as shown in FIG. 2, or the filament 102*b* is fixedly welded such that it passes through the body of porous pellet 101, as shown in FIG. 3.

Also, as another example of the type of the porous pellet directly fixed to the filament, the present applicant has also proposed a cathode structure in which filaments 102 are directly welded to at least three points on the outer sides of a porous pellet 101 impregnated with an electron-radiating material as shown in FIG. 4. In a such a conventional directly heated cathode structure, according to the contact type of the filament, filament 102*c* is directly welded to at least three points on the sides of the pellet 101, as shown in FIG. 5, or filament 102*d* is fixed such that it passes through the body of porous pellet 101 crosswise, as shown in FIG. 6.

The above-mentioned directly heated cathode structures need only a very short interval for starting thermionic emission after current is applied and exhibit high-density thermionic emission, since the porous pellet is directly heated by the filament current with the filament in contact with the pellet. However, in the above-described cathode structure, the process of welding the filament to the pellet is difficult to achieve in practice. Accordingly, it is not easy to maintain high quality and the productivity is lowered.

SUMMARY OF THE INVENTION

To solve the problems of the conventional art, it is an object of the present invention to provide a directly heated cathode structure which allows a fast thermionic emission by improving the welding reliability of a porous pellet and a filament and improves quality and productivity by stabilizing the supportive structure of the filament for the porous pellet.

It is another object of the present invention to provide a directly heated cathode structure producing having a high-density current which can greatly reduce picture display time and has greatly prolonged life.

To accomplish the above objects, there is provided a directly heated cathode structure comprising a porous pellet impregnated with cathode material, and a filament for supporting the porous pellet, wherein the filament is fixed to the porous pellet by an auxiliary member.

Also, there is provided a directly heated cathode structure comprising a porous pellet into which cathode material is impregnated, a filament for supporting the porous pellet, a support for supporting the filament, an insulation block for supporting the support; and an auxiliary member positioned under the porous pellet, for supporting the filament.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
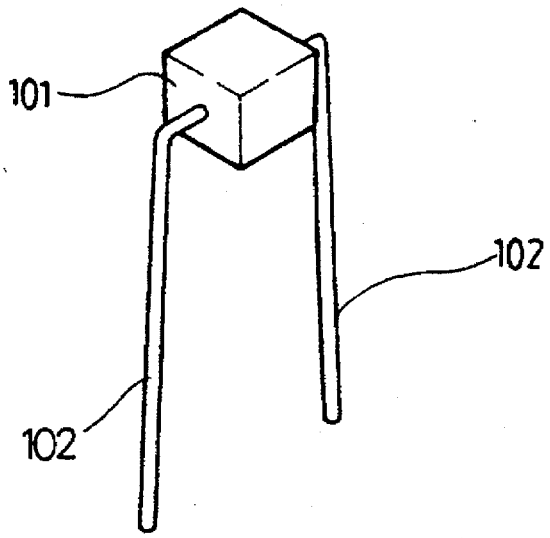
FIG.1(PRIOR ART)
FIG. 1 is a perspective view illustrating the essential parts of a conventional directly heated cathode structure.
Figure 2:
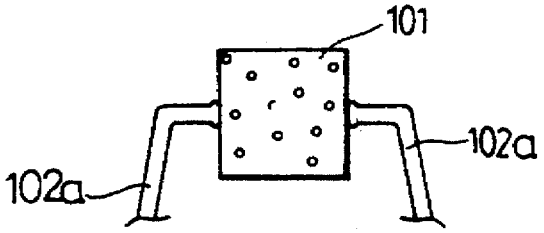
FIG.2(PRIOR ART)
FIGS. 2 and 3 are sectional views illustrating examples of the directly heated cathode structure shown in FIG. 1.
Figure 3:
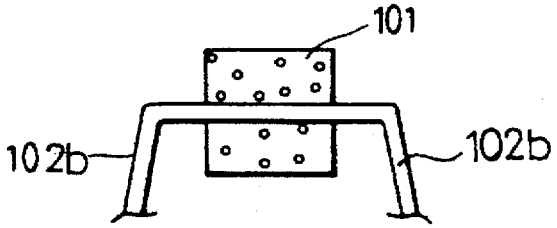
FIG.3(PRIOR ART)
Figure 4:
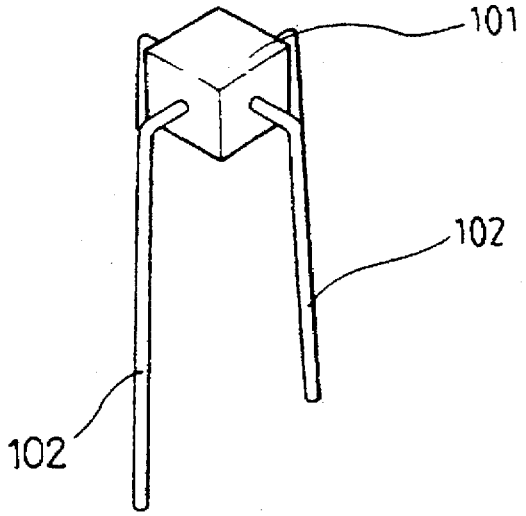
FIG.4(PRIOR ART)
FIG. 4 is a perspective view illustrating the essential parts of another conventional directly heated cathode structure.
Figure 5:
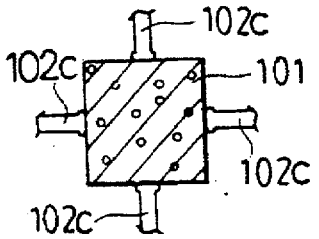
FIG.5(PRIOR ART)
FIGS. 5 and 6 are cross-sectional views illustrating examples of the directly heated cathode structure shown in FIG. 4.
Figure 6:
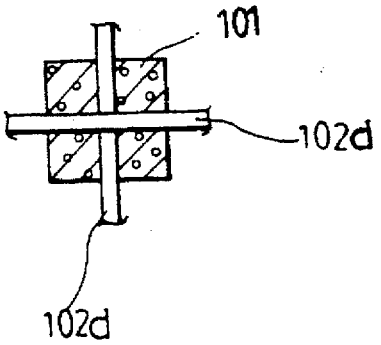
FIG.6(PRIOR ART)
Figure 7:
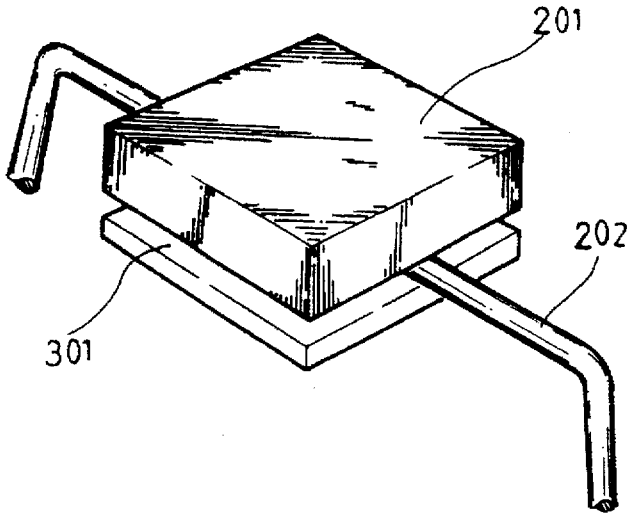
FIGS. 7, 8, 9, 10, and 11 are perspective views illustrating various embodiments of the directly heated cathode structure using a single auxiliary member according to the present invention.
Figure 8:
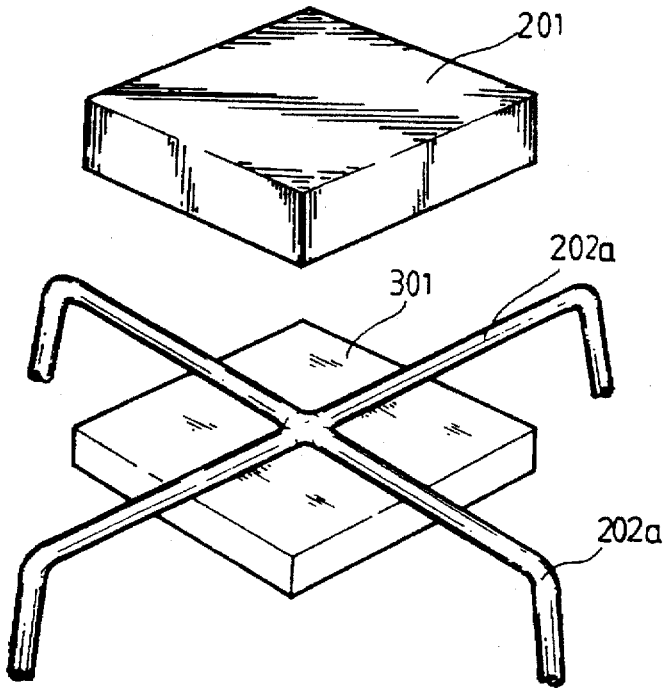
Figure 9:
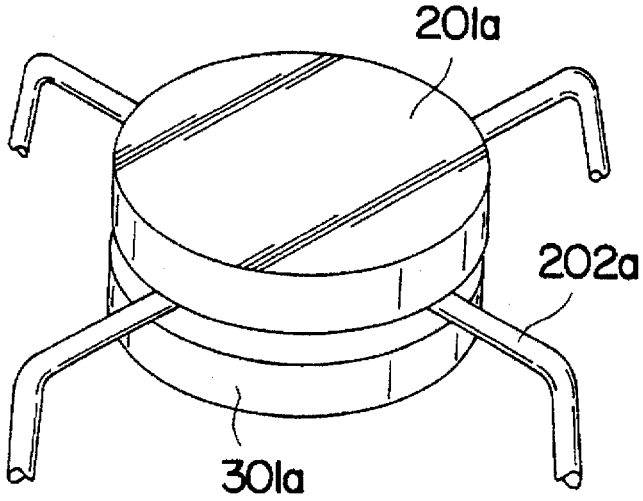
Figure 10:
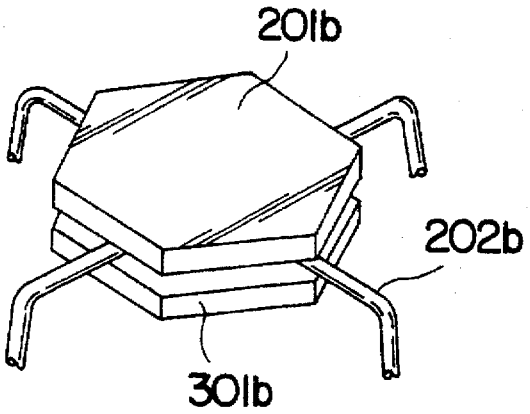
Figure 11:
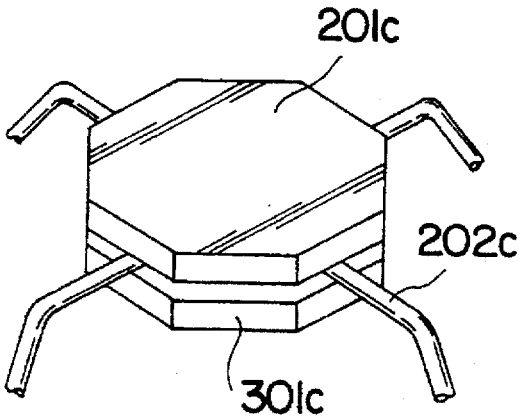
Figure 12:
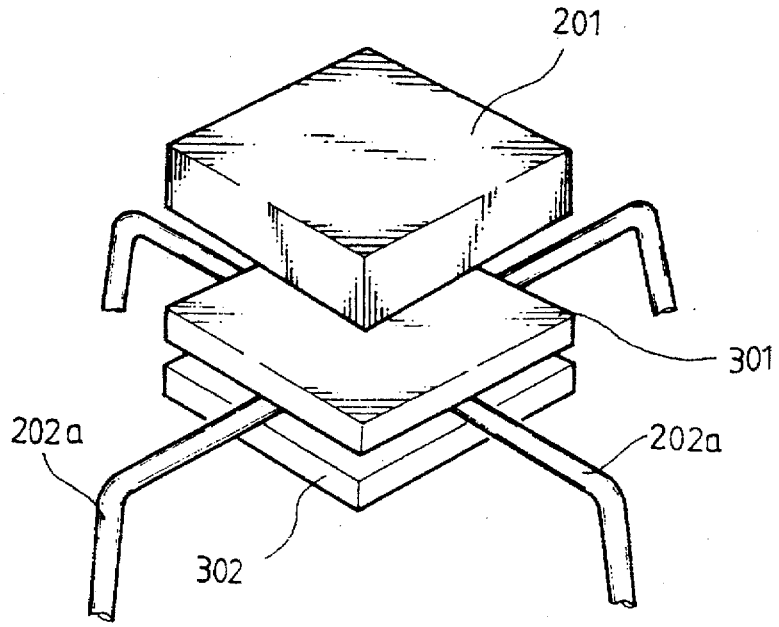
FIGS. 12, 13, 14, 15, and 16 are perspective views illustrating various embodiments of the directly heated cathode structure using two auxiliary members according to the present invention.
Figure 13:
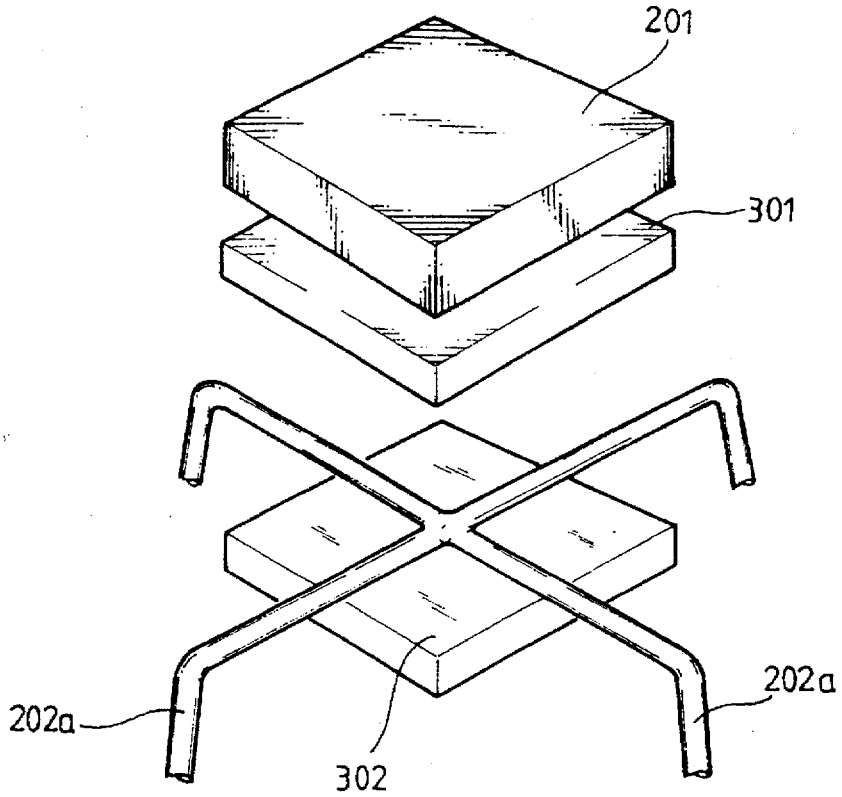
Figure 14:
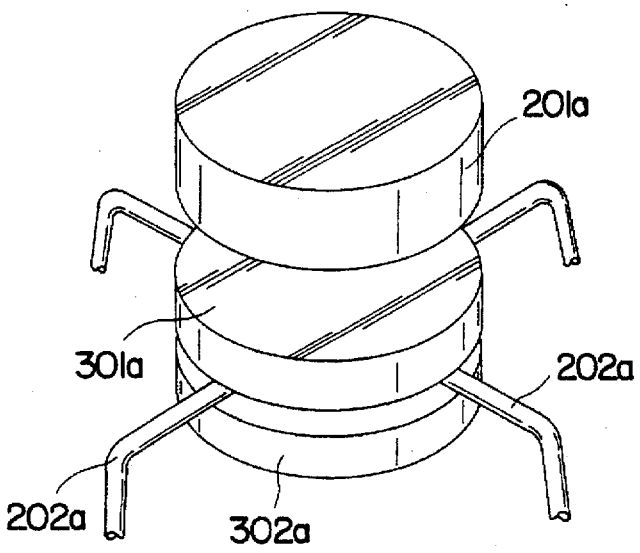
Figure 15:
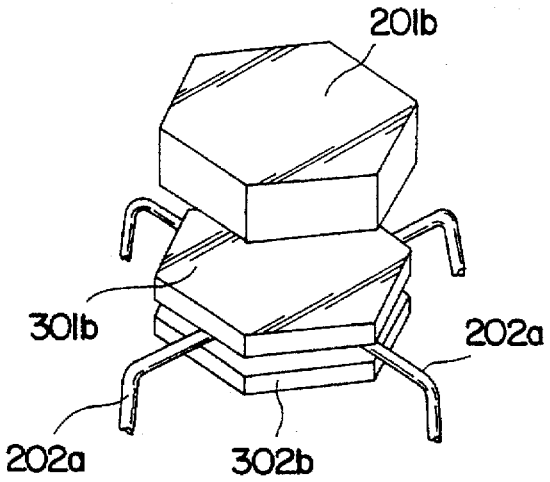
Figure 16:
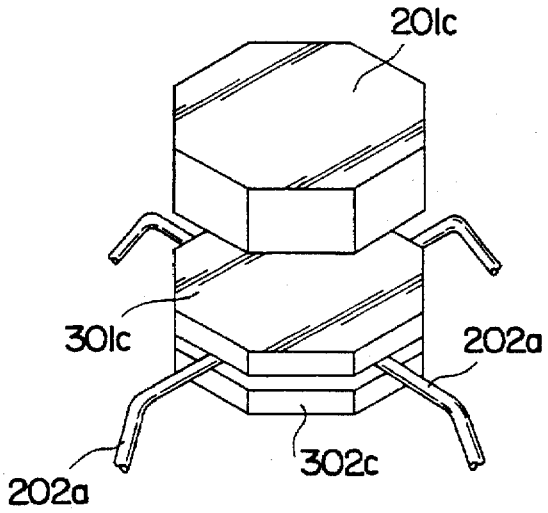

Referring to FIGS. 7 through 11, a directly heated structure of a cathode according to the present invention includes a porous pellet 201 as a thermionic emitter, which is obtained by compression-molding a powder of a high-melting point metal such as tungsten or molybdenum and sintering the same. Porous pellet 201 may have variously shaped cross-sections (e.g., circle (201*a*), hexagon (201*b*) or octagon (201*c*)), as shown in the several embodiments.

In order to fix a filament 202 to porous pellet 201 by welding, there is provided an auxiliary member 301 positioned below porous pellet 201 coinciding with the center axis of porous pellet 201. Like porous pellet 201, auxiliary member 301 may also have such variously shaped cross-sections (e.g., circle (301*a*), hexagon (301*b*) or octagon (301*c*)),but preferably has the same shape as porous pellet 201.

Filament 202 is placed on auxiliary member 301 so as to be partially in contact therewith and porous pellet 201 is fixed so as to be positioned coaxially with auxiliary member 301 by welding, e.g., resistance welding, laser welding or plasma welding.

It is preferable that filament be fixedly welded between porous pellet 201 and auxiliary member 301 be integrally formed in view of the overall structure. At this time, several filament legs are exposed to the outside of porous pellet 201 and auxiliary member 301.

According to another embodiment of the present invention, the filament is fixedly welded crosswise between porous pellet 201 and auxiliary member 301. Here, four filament legs 202*a* extended downward from the outside of the body of porous pellet 201 and auxiliary member 301. Thus, filament 202 functions not only as a heat emitter but also as a supporter for pellet 201. Therefore, even if the strength of filament 202 is decreased by direct heating, at least three filament legs 202*a* support pellet 201 in a balanced manner, to stabilize the supporting structure of pellet 201. Since pellet 201 becomes less sensitive to the external shock, screen vibration or color changes in a CRT can be minimized.

In another preferred embodiment of the present invention, at least two auxiliary members may be used. As shown in FIGS. 12 through 16, a first metal member 301 (301*a*, 301*b* or 301*c*) and a second metal member 302 (302*a*, 302*b* or 302*c*) are stacked under porous pellet 201, and filament 202 is positioned and supported between the lower surface of first metal member 301 and the upper surface of second metal member 302.

As described above, the shapes and fixation methods of the filament, porous pellet and auxiliary member(s) constituting the directly heated cathode structure using a plurality of auxiliary members are the same as those constituting the directly heated cathode structure using a single auxiliary member of various embodiments shown in FIGS. 7 through 11.

In the cathode structure according to the present invention, the heating time varies depending on the size and material of the pellet and filament, which results in a difference in the initial electron emission time. In other words, both the effects and the simplicity in the practical manufacturing should be considered. Therefore, the size and material of the pellet, filament, auxiliary member are limited to a preferable state. In the present invention, the filament is mainly composed of either tungsten (W) or molybdenum (Mo), and rhenium (Re) or ruthenium (Ru) may be added to tungsten (W). Also, the filament has a diameter range of 30 μm to 100 μm, and has a length range of 2 mm to 20 mm, preferably 2.5 mm to 5.0 mm.

Also, a film formed of osmium (Os) or ruthenium (Ru) coats on the porous pellet. It is preferable that the porous pellet have a diameter range of 0.5 mm to 2.0 mm, and has the thickness range of 0.2 mm to 2.0 mm.

The auxiliary member is made of a metal mainly consisting of one of tungsten (W), molybdenum (Mo) and tantalum (Ta). It is preferable that the auxiliary member have a diameter range of 0.3 mm to 2.0 mm, and have a thickness range of 0.02 mm to 2.0 mm.

In the case of the cathode structure having two auxiliary members 301 and 302, it is preferable that first and second metal members 301 and 302 have a diameter range of 0.3 mm to 2.0 mm, and have a thickness range of 0.02 mm to 2.0 mm.

Figure 17:
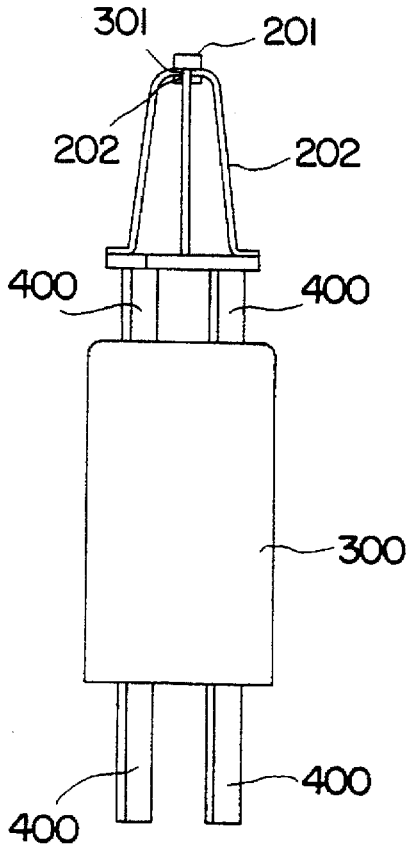
FIG. 17 is a side view illustrating the state where the directly heated cathode structure according to the present invention is assembled for use in a monochrome cathode ray tube.

FIG. 17 shows a detailed example of the directly heated cathode structure according to the present invention used for a monochrome cathode ray tube. Pellet 201 is hexahedral and filaments 202 protrude from its four lateral sides. These filaments 202 are fixedly welded on two supporters 400 installed upright on the upper end of a fixed block 300. Here, two filaments 202 are fixedly welded on each supporter 400 so that the two filaments are connected in parallel. Thus, the current is applied through the two filaments and is dissipated therefrom.

Figure 18:
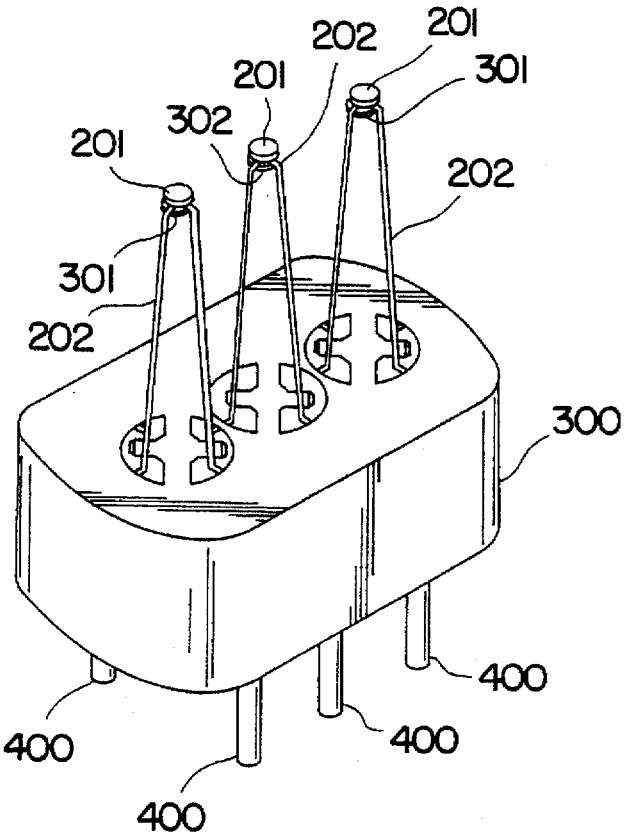
FIG. 18 is a side view illustrating the state where the directly heated cathode structure according to the present invention is assembled for use in a color cathode ray tube.

FIG. 18 shows a detailed example of the directly heated cathode structure according to the present invention used for a color cathode ray tube, in which there is provided three cathode structures of the present invention on an insulation block 300 and each pellet has a pair of supporters 400 for applying current.

It should be appreciated that any gaps, i.e., between pellet 201 and auxiliary member 301, or between first metal member 301 and second metal member 302 for two auxiliary members, which are present after the filaments 202 are fixedly welded, serve no practical purpose. Rather, these are merely for the sake of the foregoing explanation.

As described above, according to the directly heated cathode structure according to the present invention wherein a single auxiliary member or a plurality of auxiliary members are provided in a pellet for fixing a plurality of filaments, the supporting structure is very strong and quality and productivity can be greatly improved by improvement of the welding process. In other words, even when a shock is applied to the pellet, the structure has a resistance against vibration and is not deformed. Also, owing to such vibration suppression, the extent of relative positional change of a first grid in an electron gun can be extremely reduced. The suppressed relative positional change between cathode and first grid prevents the generation of screen vibrations and abnormal colors, stabilizing picture quality. Particularly, perpetual deformation due to a long period of operation can be effectively suppressed. The cathode structure according to the present invention is suitable for a color CRT, specifically a large screen television or a computer monitor CRT.

What is claimed is:

1. A directly heated cathode structure comprising:

a porous pellet impregnated with a cathode material;

a filament supporting said porous pellet; and an auxiliary member fixing said filament to said porous pellet, said filament being disposed between said auxiliary member and said porous pellet.

2. The directly heated cathode structure as claimed in claim 1, wherein said filament is transverse to said porous pellet and said auxiliary member.

3. The directly heated cathode structure as claimed in claim 1, wherein said filament includes tungsten and one metal selected from the group consisting of ruthenium and rhenium.

4. The directly heated cathode structure as claimed in claim 1, wherein said filament has a diameter of 30 to 100 μm and a length of 2 to 20 mm.

5. The directly heated cathode structure as claimed in claim 1, including a osmium film coating said porous pellet.

6. The directly heated cathode structure as claimed in claim 1, including a ruthenium film coating said porous pellet.

7. The directly heated cathode structure as claimed in claim 1, wherein said porous pellet has a diameter of 0.5 to 2.0 mm and a length of 0.2to 2.0 mm.

8. The directly heated cathode structure as claimed in claim 1, wherein said auxiliary member includes a metal selected from the group consisting of tungsten, molybdenum and tantalum.

9. The directly heated cathode structure as claimed in claim 1, wherein said auxiliary member has a diameter of 0.3 to 2.0 mm and a length of 0.02 to 2.0 mm.

10. The directly heated cathode structure as claimed in claim 1, including at least two auxiliary members.

11. The directly heated cathode structure as claimed in claim 1, wherein said auxiliary member includes first and second metal members and said filament is positioned between said first metal member and said second metal member.

12. A directly heated cathode structure comprising:

a porous pellet impregnated with a cathode material;

a filament connected to said porous pellet;

a support supporting said filament;

an insulation block supporting said support; and an auxiliary member fixing said filament to said porous pellet and supporting said filament wherein said filament is disposed between said porous pellet and said auxiliary member.

13. The directly heated cathode structure as claimed in claim 12, wherein said filament is transverse to said porous pellet and said auxiliary member.

14. The directly heated cathode structure as claimed in claim 12, wherein said filament includes tungsten and one metal selected from the group consisting of ruthenium and rhenium thereto.

15. The directly heated cathode structure as claimed in claim 12, wherein said filament has a diameter of 30 to 100 μm and a length of 2 to 20 mm.

16. The directly heated cathode structure as claimed in claim 12, including a osmium film coating said porous pellet.

17. The directly heated cathode structure as claimed in claim 12, including a ruthenium film coating said porous pellet.

18. The directly heated cathode structure as claimed in claim 12, wherein said porous pellet has a diameter of 0.5 to 2.0 mm and a length of 0.2 to 2.0 mm.

19. The directly heated cathode structure as claimed in claim 12, said auxiliary member includes a metal selected from the group consisting of tungsten, molybdenum and tantalum.

20. The directly heated cathode structure as claimed in claim 12, wherein said auxiliary member has a diameter of 0.3 to 2.0 mm and a length of 0.02 to 2.0 mm.

21. The directly heated cathode structure as claimed in claim 12, including at least two auxiliary members.

22. The directly heated cathode structure as claimed in claim 12, wherein said auxiliary member includes first and second metal members and said filament is positioned between said first metal member and said second metal member.

23. The directly heated cathode structure as claimed in claim 12, including a plurality of pairs of supports in said insulation block and a porous pellet corresponding to each of said pairs of supports.

24. The directly heated cathode structure as claimed in claim 23, including three pairs of supports and three porous pellets.

* * * * *

UNITED STATES PATENT AND TRADEMARK OFFICE

CERTIFICATE OF CORRECTION

PATENT NO. : 5,668,434

DATED : September 16, 1997

INVENTOR(S) : Kim et al.

It is certified that error appears in the above-indentified patent and that said Letters Patent is hereby corrected as shown below:

Column 4, Line 66, after "molybdenum" insert --,--;

Column 5, Line 27, after "rhenium" delete --thereto--;

Column 6, Line 11, after "molybdenum" insert --,--.

Signed and Sealed this

Tenth Day of February, 1998

*Attest:*

*Attesting Officer*

BRUCE LEHMAN

*Commissioner of Patents and Trademarks*